109-49.5
9/23/86 OR 4,612,864

United States Patent [19]
Beck et al.

[11] Patent Number: 4,612,864
[45] Date of Patent: Sep. 23, 1986

[54] FASCIA PROTECTIVE DOOR MECHANISM

[75] Inventors: Robert J. Beck; Jack Richardson, both of Stark County, Ohio

[73] Assignee: Diebold, Incorporated, Canton, Ohio

[21] Appl. No.: 664,903

[22] Filed: Oct. 26, 1984

[51] Int. Cl.[4] ..... E06B 9/00
[52] U.S. Cl. ..... 109/49.5; 109/24.1; 109/73; 49/345
[58] Field of Search ..... 109/2, 11, 19, 24.1, 109/49.5, 59 T, 69, 70, 73, 74; 194/DIG. 26; 221/281; 49/344, 345

[56] References Cited

U.S. PATENT DOCUMENTS 2,755,082 7/1956 D'Azzo ..... 49/345
3,059,840 10/1962 Graber et al. ..... 109/19
4,399,755 8/1983 Wiedmann ..... 109/24.1
4,497,261 2/1985 Ferris et al. ..... 109/24.1

*Primary Examiner*—Gary L. Smith
*Assistant Examiner*—Neill Wilson
*Attorney, Agent, or Firm*—Ralph E. Jocke

[57] ABSTRACT

A mechanism for protecting an automatic teller machine against entry through the opening in the fascia when the machine which normally occupies the opening is not occupying the opening, including a door (33) for closing the opening, a link (25) for operating the door, a Geneva claw (29) for moving the link between door opening and door closing positions in response to movement of the machine between conditions respectively occupying and not occupying the opening, and a locking pawl (31) for preventing opening of the door when the machine is not occupying the opening.

15 Claims, 20 Drawing Figures

FASCIA PROTECTIVE DOOR MECHANISM

BACKGROUND OF THE INVENTION

This invention relates to automatic teller machines ("ATM"s), and in particular to means for protecting an ATM against damage and improper access when it is being serviced.

ATMs are widely used for providing banking services and the like, such as dispensing cash to customers, accepting deposits, transferring money between accounts, checking account balances, and paying utility bills. The ATM is actuated by the customer by insertion of an appropriate card in a receptable in the machine, and the keying in of the customer's identification number through a keyboard. The nature of the transaction desired is indicated by the customer through the keyboard. ATMs usually have a fascia which is basically a face plate having an opening where customer accessible components of the machine are located when the machine is in operating condition, such components including for example a receptacle for accepting an identification card and a dispensing mechanism for dispensing a receipt of a transaction. These components are normally mounted on the forward position of a chassis, and the chassis is positioned in its operating position so that the customer accessible components occupy the fascia opening.

Occasionally, the chassis must be retracted from the fascia such as for servicing and repairs. Since ATMs are generally permanently installed at outdoor locations, building lobbies and the like which are always open to the public, and where there are often no bank personnel stationed, problems can arise where the chassis of an ATM has been retracted leaving the fascia of the machine in place. An ATM with its chassis out of place is normally rendered inoperative and should not be used. Nevertheless, customers seeking to use the machine might try to gain access to the customer accessible components through the fascia opening. Furthermore, it is important to prevent the placing of objects in the fascia opening when the chassis is retracted, to avoid damage to the fascia or the chassis when it is returned to its forward, operating position. Also it is important to keep the fascia opening closed to protect the ATM against the weather, either by means of the chassis itself or some alternative device.

Previous means for closing the fascia opening when the chassis of an ATM is retracted have been manually operated. These suffer from different shortcomings. For one, the usefulness of such manually operated devices depends upon the person servicing the ATM to move the device to its closed position when the chassis is withdrawn, and to move it to its open position when the chassis is returned to its operating position. There are devices known for protecting ATMs from the environment when they are not in use, such as those disclosed in U.S. Pat. Nos. 4,393,788 and 4,251,009, but these do not relate to devices for protecting the ATM when a portion of the ATM such as the chassis is moved out of operating position.

SUMMARY OF THE INVENTION

It is an object of the invention to close an opening in a wall of a security machine, such as an opening in the fascia of an automatic teller machine, when a portion of the machine which normally occupies the opening is moved out of that opening.

Another object of the invention is to provide a device for closing the opening in the fascia of an ATM which is normally closed by customer accessible components on the chassis of an ATM, when the chassis is moved leaving the fascia opening unoccupied.

A further object of the invention is to provide a door operating mechanism for automatically closing the fascia opening of an ATM when the chassis of the ATM whose components normally occupy that opening is retracted to render the opening unoccupied.

Yet another object is to provide a door operating mechanism as described above which effectively and securely closes a fascia opening of an ATM when the chassis is retracted.

An additional object is to provide a door operating mechanism as described above which is practicable to manufacture, and efficient in manufacture and use.

Other objects will be apparent from the description to follow and from the appended claims.

The foregoing objects are achieved according to the preferred embodiment of the invention by the provision of a door operating mechanism including a door assembly for selectively closing a fascia opening of an ATM, a crank assembly for rotating the door about an axis, a link for rotating the crank assembly, a Geneva claw for transmitting movement from a drive pin on the chassis to the link, and a locking pawl for blocking the Geneva claw against movement to prevent back-driving of the mechanism as where a customer tries to force the door assembly open from a closed position.

DESCRIPTION OF THE PREFERRED EMBODIMENT

Figure 1:
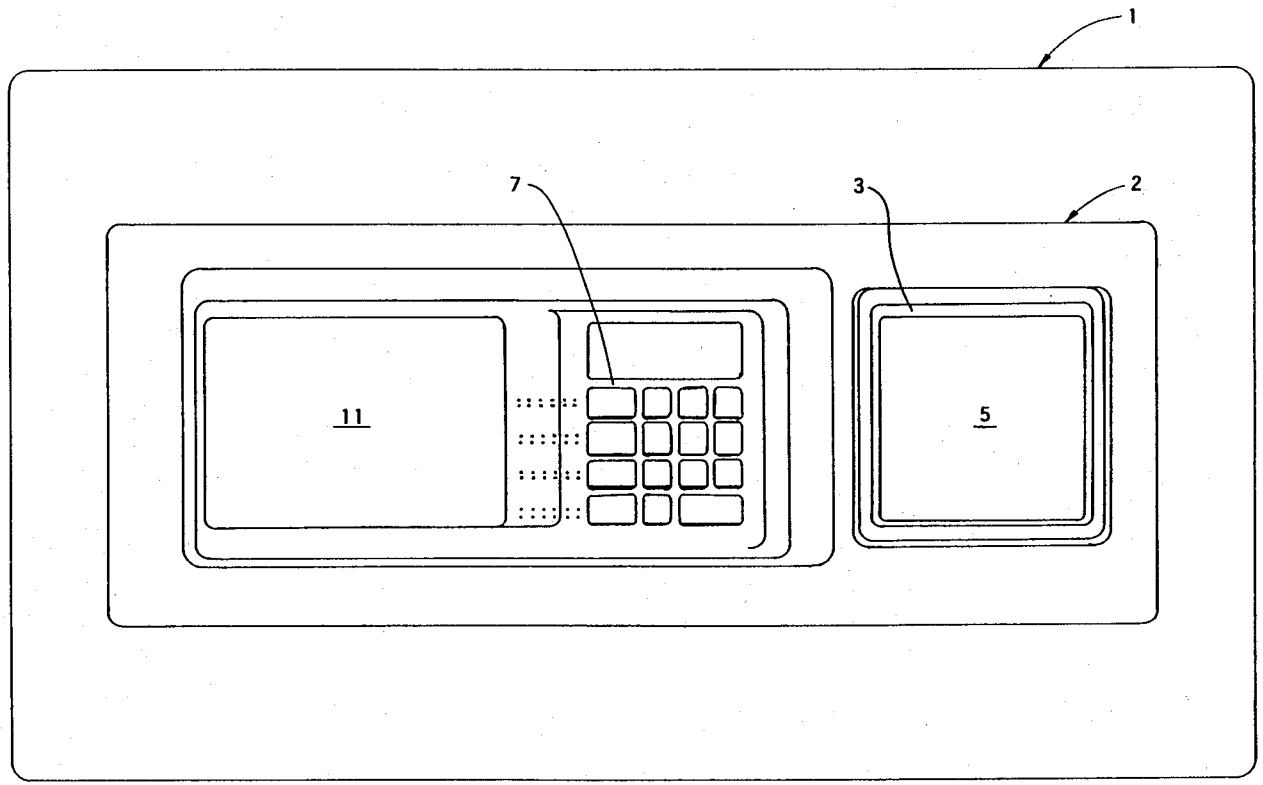
FIGS. 1 and 2 are front and side views, respectively, of an ATM of the type with which the present invention can be incorporated, shown with its chassis in its operating position.
Figure 2:
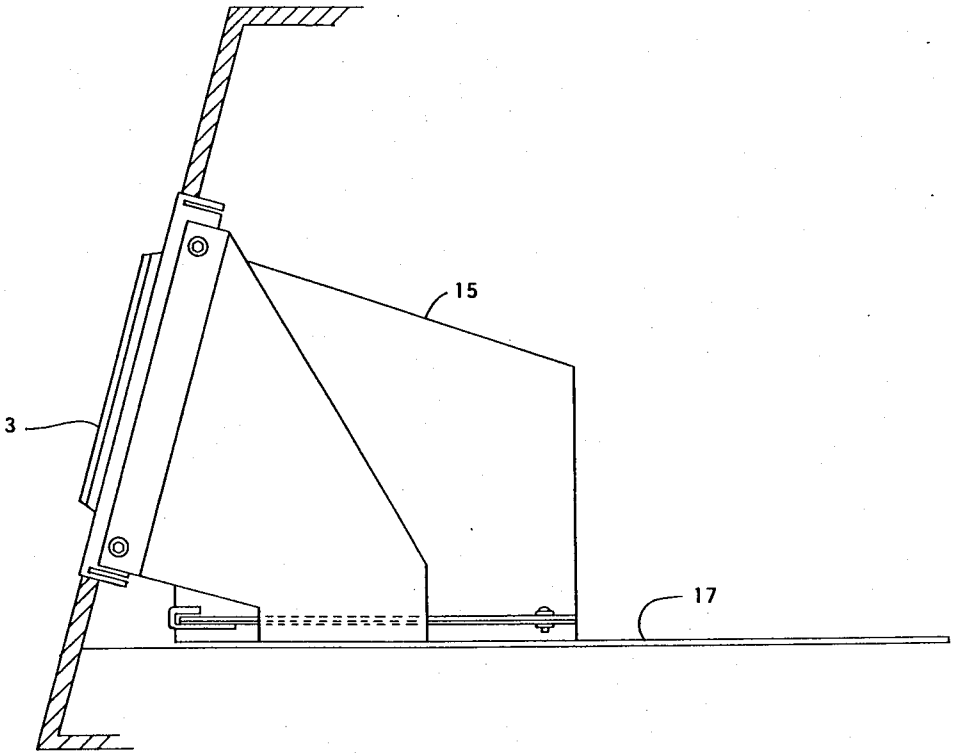

Referring first to FIGS. 1 and 2, an ATM 1 is shown having customer interface panel 2 which includes a fascia 3 having four walls defining a fascia opening 5 through which a receipt exit/card entry bezel (not shown) part of a chassis is normally accessible, a keyboard 7, and a display screen 11. ATM 1 further includes a movable machine in the form of a chassis 15 which contains printers, a paper supply and card reader—none of which are separately identified. Fascia 3 and chassis 15 are mounted on a base 17, and chassis 15 can be moved on a track on base 17 from a forward, operating position in which the receipt exit/card entry bezel occupies opening 5, and a rearward, retracted position wherein the chassis is separated from fascia 3 for servicing. As indicated earlier, the present invention provides a door operating mechanism for closing opening 5 when chassis 15 is in the rearward position to deny entry through opening 5, and for opening opening 5 when chassis 15 is in its forward operating position.

Figures 3, 5:
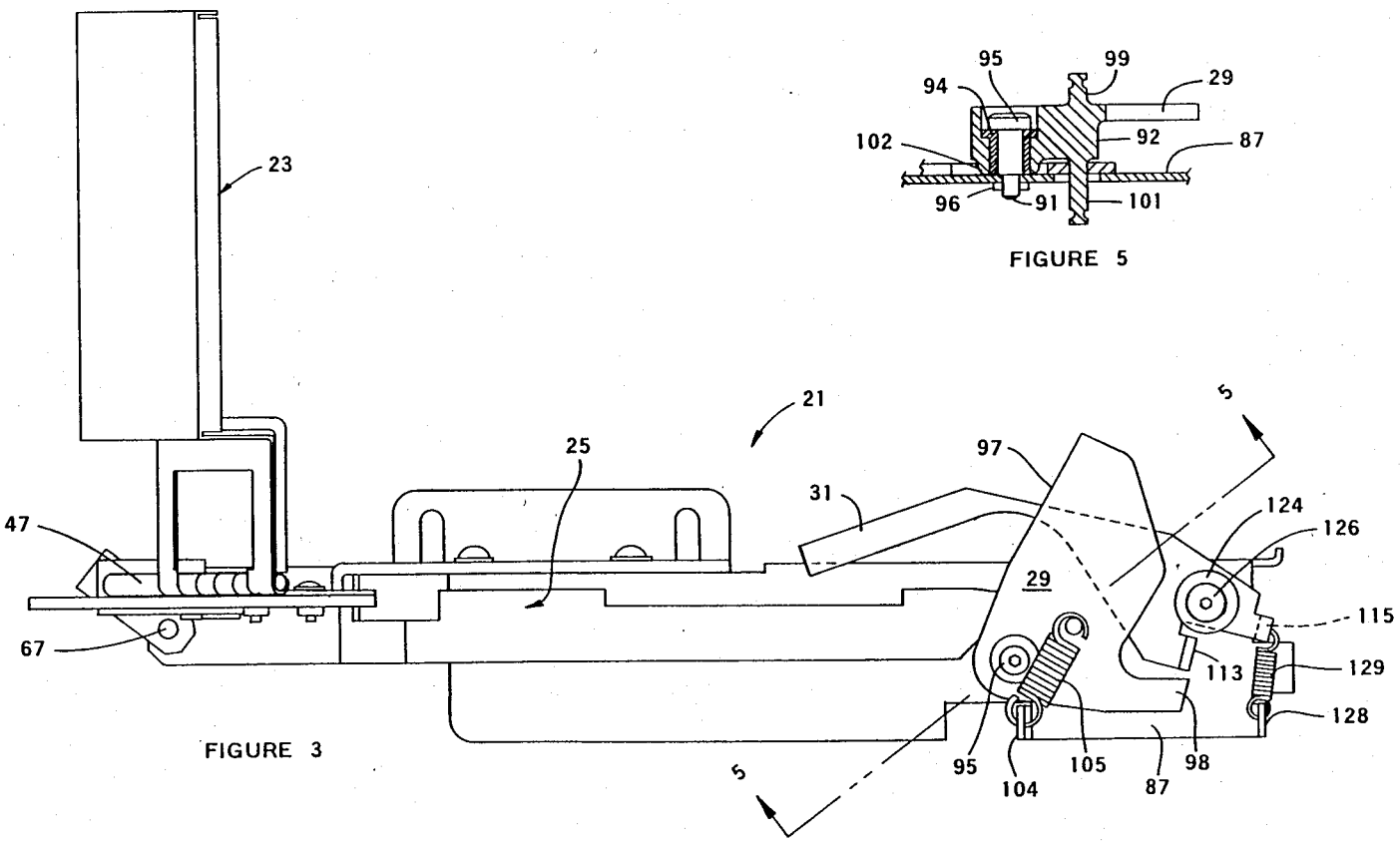
FIGS. 3 and 4 are a plan view and a side elevation of a door operating mechanism according to the preferred embodiment of the invention.
FIG. 5 is a cross-sectional view taken in the direction 5—5 in FIG. 3.
Figure 4:
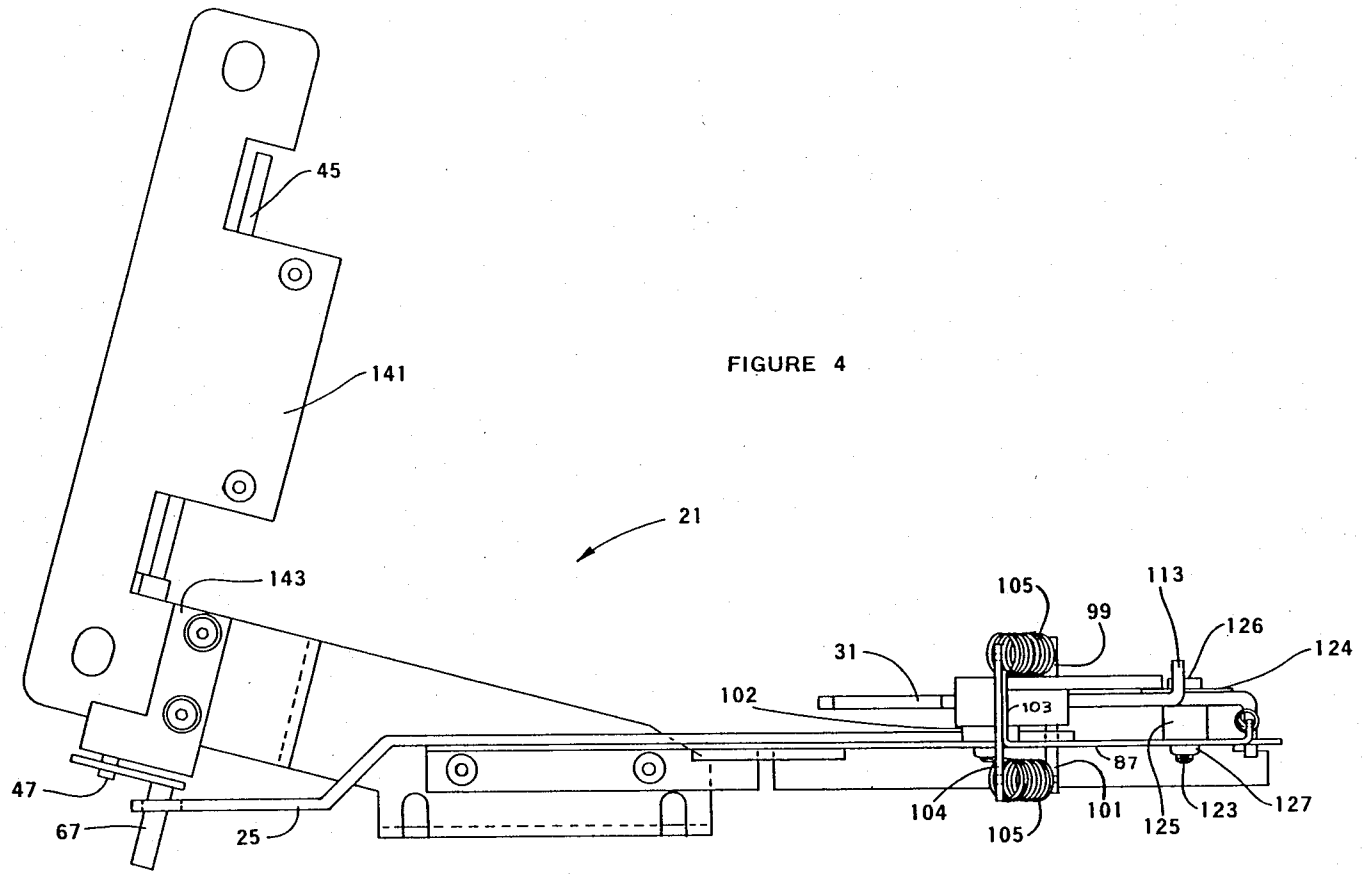

A door operating mechanism 21 is shown in FIGS. 3 and 4. This mechanism includes a door assembly 23 which is moved by linkage means comprising a link 25 in response to a chassis-driven driver assembly through the intermediary of a first member shown as a Geneva claw or lever 29. Blocking means in the form of a locking pawl 31 cooperates with claw 29 to prevent the back-driving of the mechanism through the application of force to the door assembly.

Figure 6:
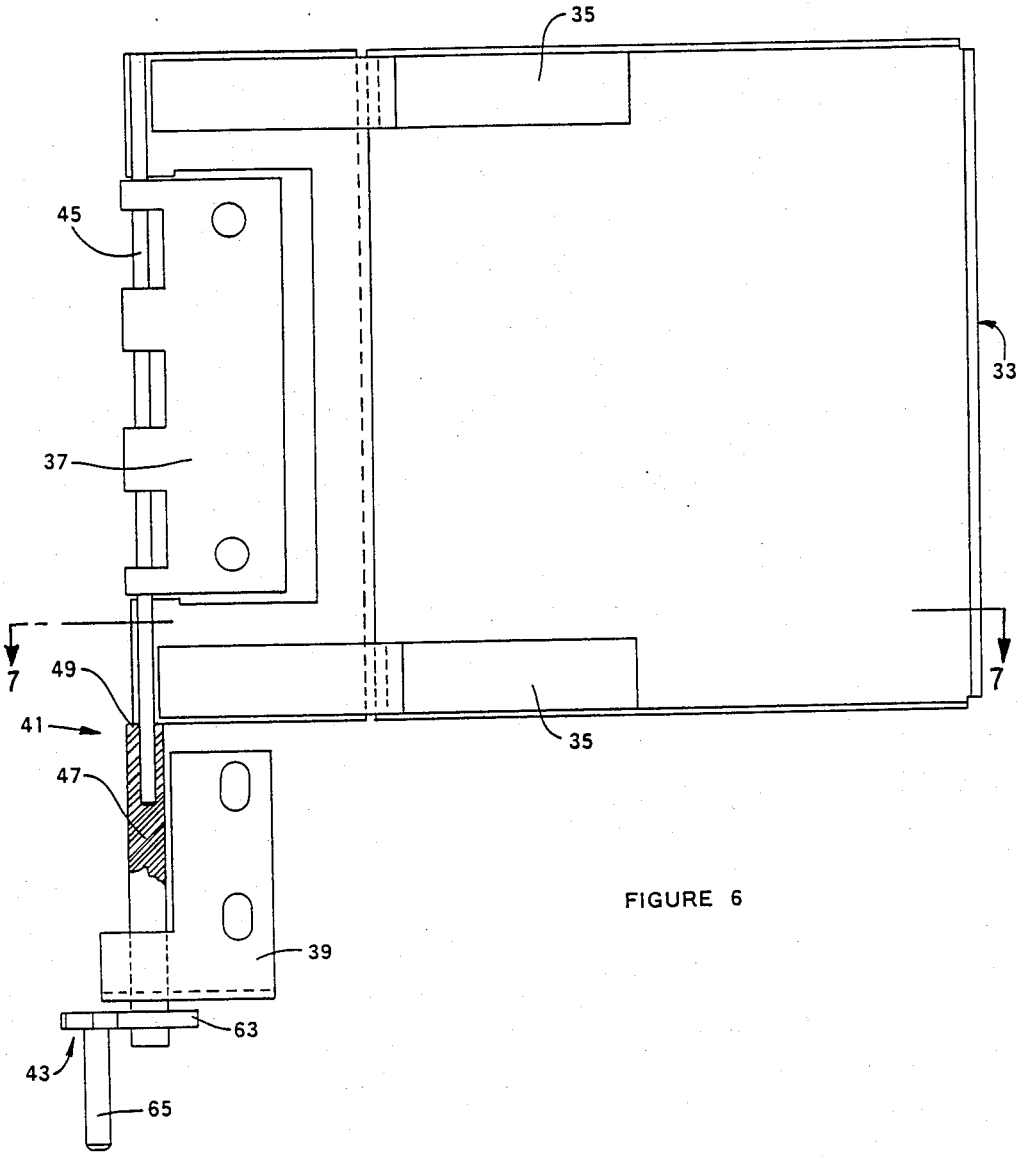
FIG. 6 is a partial cross-sectional front view of a door assembly incorporated in the device of FIGS. 3 and 4.

Door assembly 23 includes a door 33 which includes welded reinforcing members 35, and an upper hinge 37 and a lower hinge 39 through which an axle portion 41 of a crank assembly 43 extends. (See FIG. 6). Hinges 37 and 39 are attached to door 33 by appropriate means such as welding. Axle portion 41 includes a small diameter hinge pin 45 and a coaxial wider diameter hinge pin 47 fixed to pin 45. Pin 47 has at one end a shoulder 49 against which door 33 butts. The two hinges have bores dimensioned for receiving the respective hinge pins in sliding engagement so that the crank assembly rotates freely therein.

Figure 7:
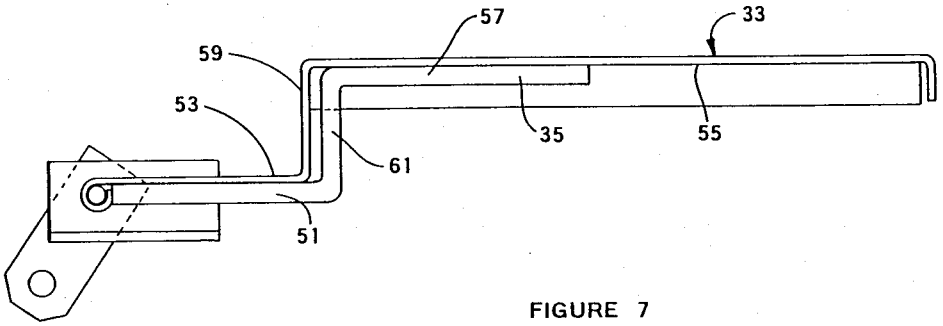
FIG. 7 is a cross-sectional view taken in the direction 7—7 in FIG. 6.

Referring to FIG. 7, it can be seen that door 33 and reinforcing members 35 include parallel, offset portions 51, 53 and 55, 57 and intermediate portions 59, 61 interconnecting and perpendicular to the respective parallel door portions.

Crank assembly 43 further includes a crank arm 63 fixed at the end of pin 47, and a crank pin 65 offset from pin 47 and also fixed to arm 63. It can be seen that upon the application of sufficient force transverse to crank pin 65, door 33 will rotate about the axis of hinge pins 45 and 47.

Figure 8:
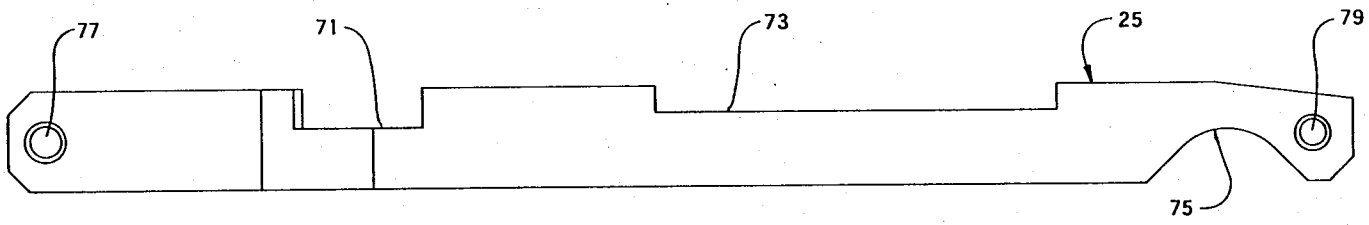
FIGS. 8 and 9 are a plan view and a side elevation of a link incorporated in the device of FIGS. 3 and 4.
Figure 9:
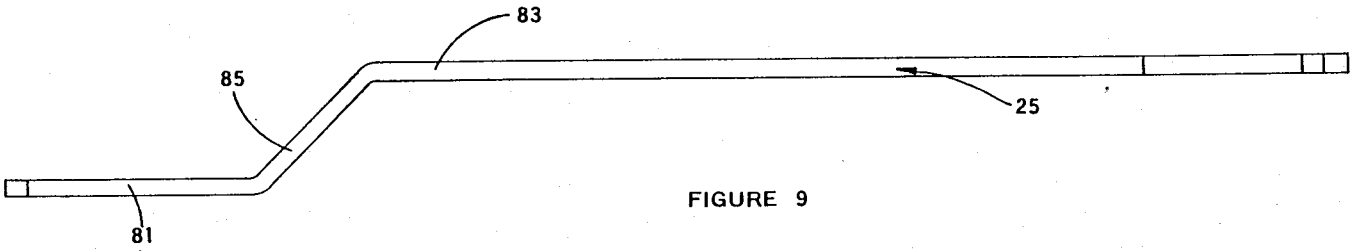

Link 25 is shown in detail in FIGS. 8 and 9. Link 25 is an elongated member which is slidable as discussed below for rotating door 33 about hinge pins 45 and 47. It has cut-outs at 71, 73 and 75 to avoid obstruction with parts which link 25 moves relative to, a hole 77 for receiving crank pin 65 and a hole 79 for receiving a pin as discussed later. Link 25 is composed of offset, parallel, forward and rearward portions 81 and 83 respectively, which are connected by a transverse section 85, the offset also being provided to enable the unobstructed movement of the link. When link 25 moves forward (towards fascia 3), it rotates crank assembly 43 to effect the opening of door 33, and when it moves rearwardly from its forward position it closes door 33. Link 25 is positioned on a platform 87 during sliding movement. As indicated in FIG. 4, hinge pins 45 and 47 and crank pin 67 are all inclined at an acute angle relative to the plane of link 25 and platform 87, wherefore the axis of hole 77 is likewise inclined to accomodate pin 67. Link 25 is preferably a stamped and formed zinc plated steel piece.

Figure 10:
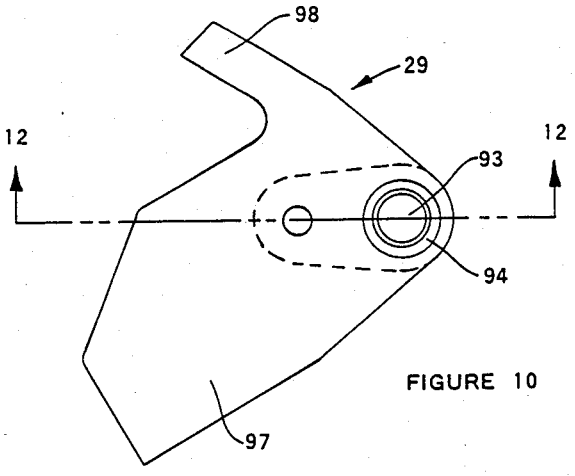
FIGS. 10 and 11 are top and bottom plan views of a Geneva claw incorporated in the device of FIGS. 3 and 4.
Figure 11:
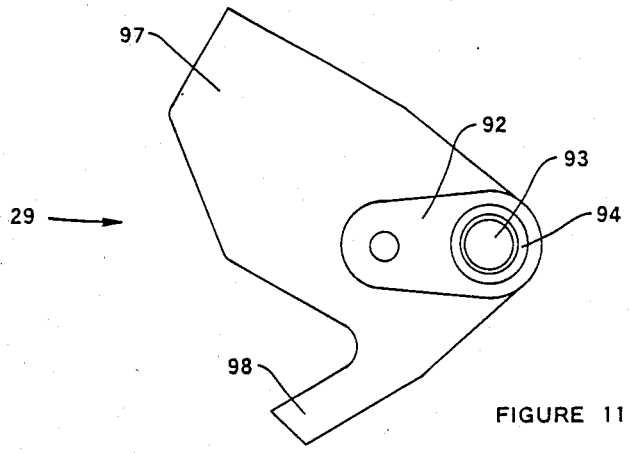
Figure 12:
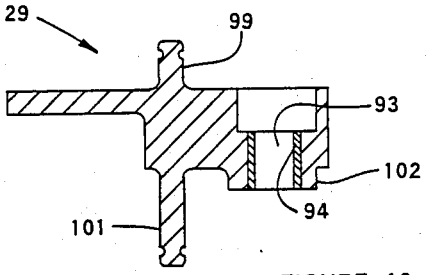
FIG. 12 is a sectional view taken in the direction 12—12 in 10.

As shown in detail in FIGS. 5, 10 and 11, Geneva claw 29 is rotatably mounted on platform 87 by means of a shoulder bolt 91 which is threaded at its lower end. Claw 29 has a thickened portion 92 which serves as a spacer between the upper part of claw 29, and link 25 and platform 87. There is a bore 93 through portion 92, and a bushing 94 is press fit therein with shoulder bolt 91 extending through the bushing. Claw 29 is retained on shoulder bolt 91 by a cap 95 on shoulder bolt 91. A nut 96 is threaded on the lower end of shoulder bolt 91 which extends through platform 87. Geneva claw 29 includes a first arm 97, a second arm 98, and vertical posts 99 and 101 extending in opposite directions from the claw. Platform 87 has a vertical tab 103 extending upwardly (see FIG. 4) and a vertical member 104 is welded to tab 103. Member 104 has holes at its upper and lower ends, and a pair of wire coil springs 105 are connected at one of their ends to the respective holes in member 104, and their other ends are attached to the respective posts 99 and 101. Springs 105 are thus mounted over center relative to the rotational axis of claw 29, and function to bias claw 29 in the clockwise direction when door 33 is closed to position arm 97 transverse to link 25 (as shown in FIG. 3) and to bias claw 29 in the counterclockwise direction when door 33 is open to position arm 98 transverse to link 25. The lower portion 102 of thickened portion 92 of claw 29 through which shoulder bolt 91 extends is cylindrical, and cutout 75 of link 25 accomodates that lower cylindrical portion. Claw 29 is preferably a stainless steel casting which has been machined to define various details of its construction.

Figure 13:
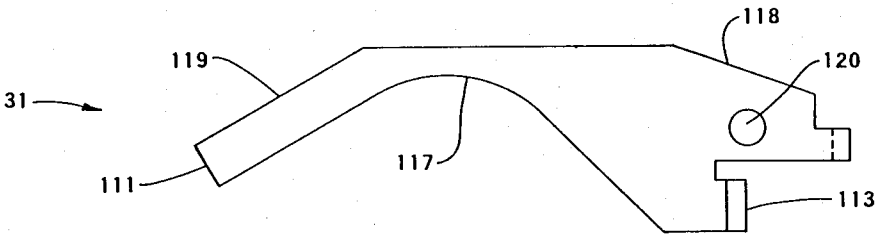
FIGS. 13 and 14 are a plan view and a side elevation of a locking pawl incorporated in the device of FIGS. 3 and 4.
Figure 14:
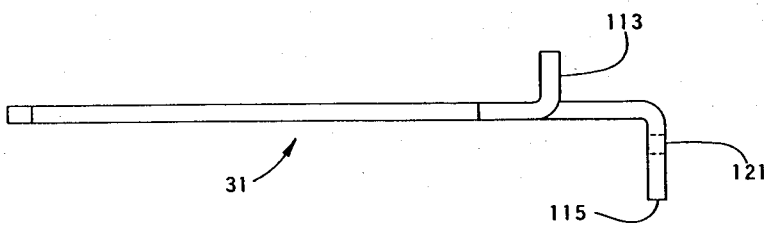

Locking pawl 31 is shown in detail in FIGS. 13 and 14. Pawl 31 includes an arm 111, an upwardly extending tab 113 for blocking the movement of arm 98 of Geneva claw 29 when door 23 is closed, a downwardly extending tab 115, a generally curved surface 117, a rearward cam surface 118, a forward cam surface 119, a hole 120 and a hole 121 through tab 115. A post 123 extends through hole 120, through a spacer 124, a bushing 125 and a similar aligned hole in platform 87 to pivotally mount locking pawl 31 on the platform. (See FIG. 4). The ends of post 123 are threaded, and a threaded cap 126 retains pawl 31 on post 123, and a nut 127 holds post 123 in platform 87. A tab 128 extends upwardly on platform 87, and is provided with a hole; a wire coil spring 129 extends at one of its ends through the hole in tab 128 and at its other end through hole 121 in tab 115, for biassing pawl 31 in the clockwise direction as shown in FIG. 3 to place the pawl in its blocking position as discussed below.

A driver assembly 27 is fixed on and movable with chassis 15. Driver assembly 27 includes a driver 131 shown in FIG. 15 on which is mounted a drive pin 133 for transmitting the motion of chassis 15 to the linkage described above.

Referring back to FIGS. 2 and 4, it can be observed that fascia 3 is inclined rearwardly relative to a vertical reference so that the surfaces defining opening 5 are likewise inclined. Therefore, various parts of the apparatus associated with the mechanism for closing and opening opening 5 are constructed accordingly. A door support 141 is bolted to fascia 3. Upper hinge 37 (FIG. 6) is bolted to door support 141 and the axis of hinge pin 45 is parallel with the plane of opening 5. A lower support bracket 143 is attached to the lower part of the door support 141, and lower hinge 39 is bolted to bracket 143 to assure the proper inclination of hinge pin 45. As indicated previously, the hole in link 25 for receiving the inclined crank pin 65 is inclined to translate the horizontal movement of link 25 into the rotation of crank assembly 43 about its axis which is inclined to be parallel with the foregoing inclination of fascia 3.

Figure 15:
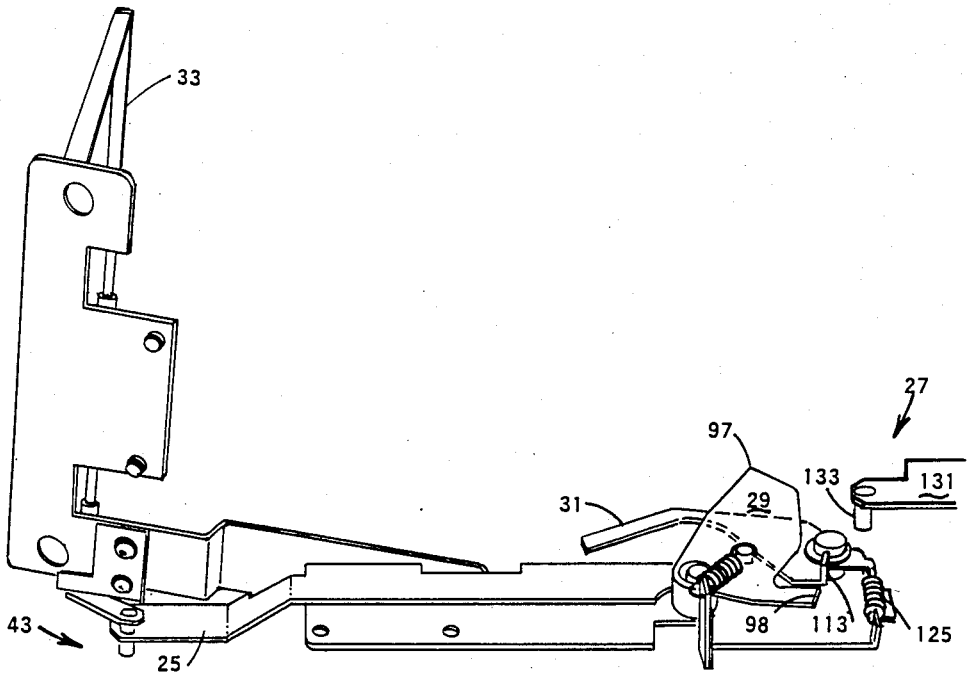
FIGS. 15 through 20 are perspective drawings showing the operation of the device of FIGS. 3 and 4.

The operation of door operating mechanism 21 will now be described with reference to FIGS. 15–20, to both explain further construction details of the mechanism as well as to describe its operation. FIG. 15 shows the mechanism in its closed condition, which is in this condition when chassis 15 is retracted. Geneva claw 29 is in its closed position with arm 97 extending across the path of the retracted drive pin 133. Door 33 is in its closed position, closing opening 5 (not shown). Locking pawl 31 is in its blocking position with its tab 113 in the path of arm 98 of Geneva claw 29, to block the claw against movement such as through the efforts of a customer to rotate door 33 from its closed position and back-drive mechanism 21. Spring 125 holds pawl 31 in the blocking position.

Figure 16:
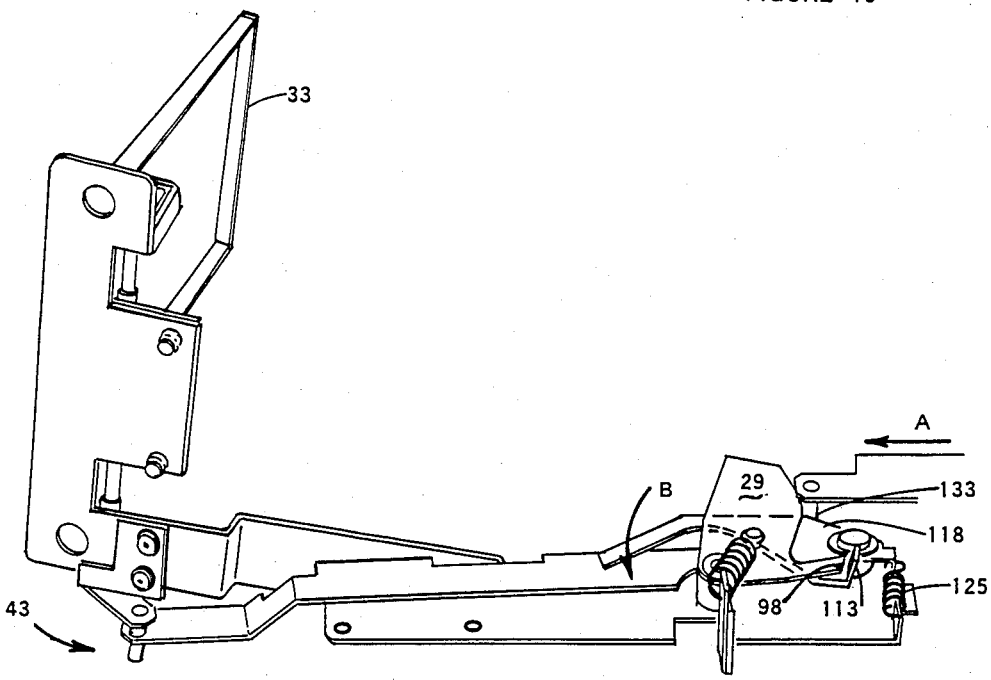
Figure 17:
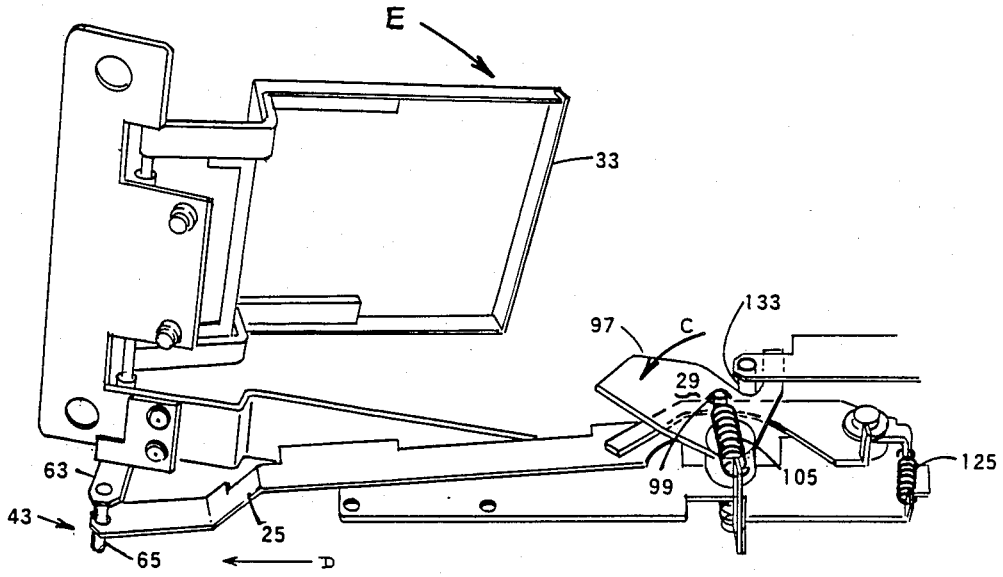
Figure 18:
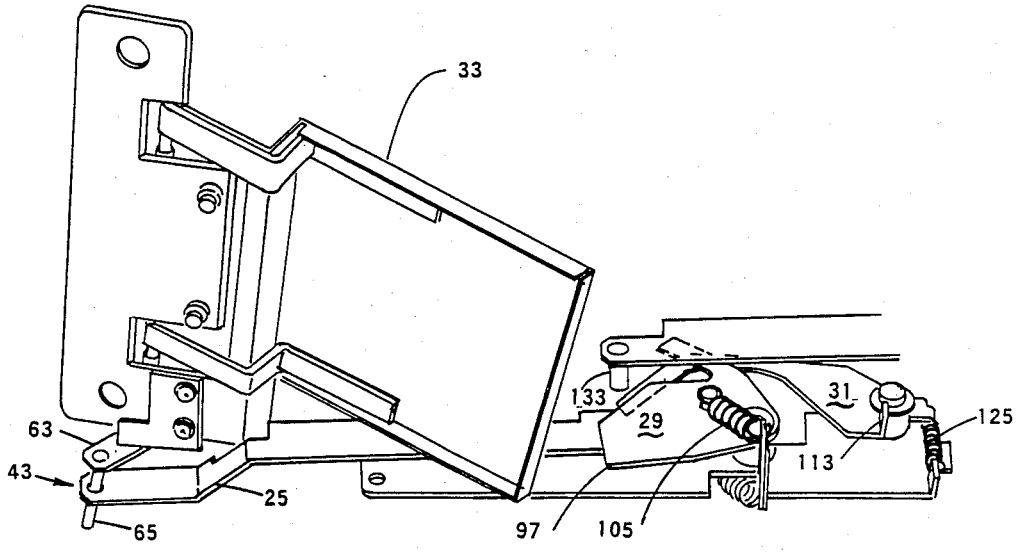

Referring next to FIG. 16, the system is shown as chassis 15 is being moved to its forward position as indicated by the arrow A. Drive pin 133 has engaged rearward cam surface 118 of pawl 31 and rotated the pawl counterclockwise (as indicated by arrow B) against the bias of spring 125 to withdraw tab 113 from the path of Geneva claw arm 98. After pin 133 disengages pawl 31, spring 125 returns the pawl to its blocking position. In FIG. 17, drive pin 133 is shown in engagement with Geneva claw arm 97, and in the process of rotating claw 29 counterclockwise (as indicated by arrow C) against the bias of springs 105. The counterclockwise rotation of Geneva claw 29 forces post 101 (extending into the plane of the Figure opposite pin 99) of claw 29 against link 25 and moves link 25 forwardly (as shown by arrow D). The forward movement of link 25 effects the clockwise rotation of crank arm 63 through the connection of link 25 and crank pin 65, this in turn causing door 33 to rotate from its closed position towards its fully opened position in the direction of arrow E. When drive pin 133 disengages Geneva claw 29, spring 105 rotates the claw counterclockwise to its fully rotated position as shown in FIG. 18 because of over the center mounting of springs 105. Door 33 assumes its fully opened position when chassis 15 is in forwardmost position with the receipt exit/card entry bezel in opening 5. In rotating to the fully open position, door 33 rotates more than 90° from the closed position to assure the unimpeded movement of the chassis between its forward position and the retracted position. The system in its fully opened condition is shown in FIG. 18.

Figure 19:
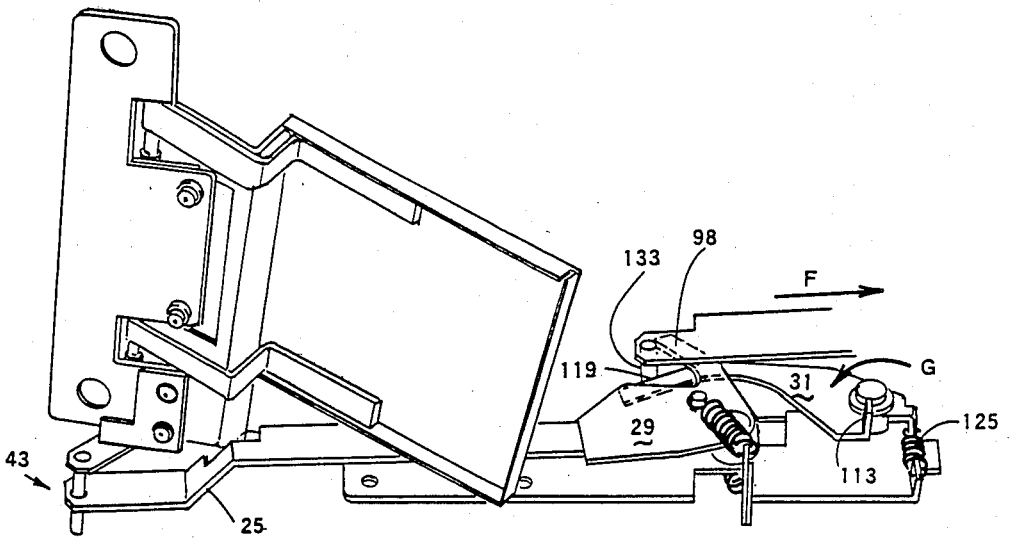
Figure 20:
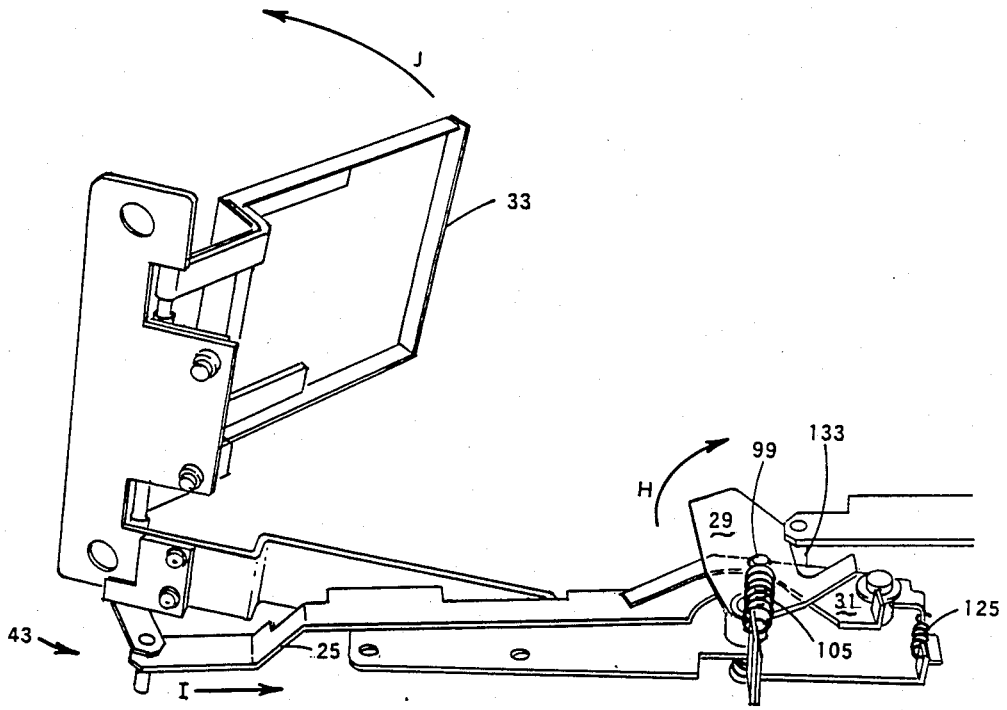

Referring to FIG. 19, as chassis 15 is withdrawn, drive pin 133 moves in the direction of arrow F and engages forward cam surface 119 of locking pawl 31 to rotate the pawl counterclockwise against the bias of spring 125, as indicated by arrow G, to remove tab 113 from the path of arm 98 of Geneva claw 29. The continued rearward movement of chassis 15 brings drive pin 133 into engagement with arm 98 of claw 29, rotating the claw (arrow H) as shown in FIG. 20, and moving link 25 rearwardly as shown by arrow I. The latter movement of link 25 rotates crank assembly 43 counterclockwise to swing door 33 towards the closed position in the direction of arrow J. When drive pin 133 pulls Geneva claw 29 beyond the top center position of pins 99 and 101, claw 29 is biased toward its original position by the force of springs 105 as shown in FIG. 20. As pin 133 is further retracted claw 29 returns to its original position as shown in FIG. 15, where it is locked by pawl 31 as explained above.

The mechanism described above thus provides an effective and efficient means for closing the customer accessible opening in a machine, such as the fascia of an ATM when the device which normally occupies the opening is removed therefrom. The mechanism is very effective in accomplishing its purposes, by closing the opening when the machine is not occupying the opening while also preventing the back driving of the member which closes the opening, and by opening the opening as the machine assumes its position occupying the opening. The various components can be made using conventional manufacturing techniques, and the assembly of the mechanism requires no special training. The invention in its preferred form is thus practicable, economical to construct, and efficient and effective in operation.

The invention has been described in detail with particular emphasis on the preferred embodiment thereof, but it should be understood that variations and modifications within the spirit and scope of the invention may occur to those skilled in the art to which the invention pertains.

We claim:

1. Apparatus comprising a wall with an opening, said wall having an internal side and an external side wherein said apparatus selectively opens and closes the opening in the wall according to the position of a machine internally disposed of said wall which selectively occupies the opening, the machine being movable between an occupying condition wherein the machine occupies the opening and a non-occupying condition wherein the machine does not occupy the opening, said apparatus further comprising:

door means for closing the opening, said door means being mounted for movement between an open position uncovering the opening and a closed position closing the opening, said door means being fully disposed internally of said opening in the open position; and linkage means operatively connected to said door means for moving said door means to the open position in response to movement of the machine to the occupying condition and for moving said door means to the closed position in response to movement of the machine to the non-occupying condition; said linkage means including blocking means for preventing movement of said door means from the closed position to the open position when the machine is in the non-occupying condition.

2. The invention according to claim 1 wherein said linkage means comprises:

link means connected to said door means and movable between first and second positions for moving said door means between the open and closed positions, respectively, a first member connected to said link means for moving said link means to the first position in response to movement of the machine to the occupying condition and for moving said link means to the second position in response to movement of the machine to the non-occupying condition;

said blocking means being movable between a blocking position for preventing movement of said link means from the second position to the first position and a releasing position for enabling movement of said link means from the second position to the first position.

3. Apparatus for selectively opening and closing an opening in wall according to the position of a machine which selectively occupies the opening, the machine being movable between an occupying condition wherein the machine occupies the opening and a non-occupying condition wherein the machine does not occupy the opening; said apparatus comprising:

door means for closing the opening, said door means being mounted for movement between an open position uncovering the opening and a closed position closing the opening;

link means connected to said door means and movable between first and second positions for moving said door means between the open and closed positions, respectively;

a first member including first and second engagement means, connected to said link means and mounted for movement relative thereto; and first biasing means for moving said first engagement means into the path of said machine when said door means is in the closed position and for moving said second engagement means into the path of said machine when said door means is in the open position and the machine is in occupying condition, said first engagement means being engageable by the machine to move said first member and move said link means from the second position to the first position in response to movement of the machine from the non-occupying condition to the occupying condition, and said second engagement means being engageable by the machine to move said first member and move said link means from the first position to the second position in response to movement of the machine from the occupying condition to the non-occupying condition.

4. The invention according to claim 3 wherein said blocking means comprises pawl means movable into the blocking position in the path of said first member to block movement of said first member when said door means is in the closed position and said first engagement means is in the path of the machine, said pawl means being movable to the releasing position in response to movement of the machine towards the occupying condition.

5. The invention according to claim 4 wherein said first member includes a rotationally mounted Geneva claw including a first arm comprising said first engagement means and a second arm comprising said second engagement means, and said pawl means comprises a locking pawl having a blocking member for blocking rotation of said Geneva claw when said door means is in the closed position, the machine engaging said locking pawl and moving said locking pawl to the releasing position as the machine approaches the occupying condition.

6. The invention according to claim 4 and further comprising second biasing means for biasing said pawl means to said blocking position.

7. The invention according to claim 5 wherein said Geneva claw has a first axis of rotation, and said first biasing means includes an over center spring connected to said Geneva claw to define a line of force on one side of said axis of rotation when said door means is in the open position to urge said first arm in the path of the machine, and to define a line of force on the opposite side of said first axis of rotation when said door means is in the closed position to urge said second arm in the path of the machine.

8. The invention according to claim 5 and further including second biasing means for biasing said locking pawl to said blocking position, said locking pawl being mounted for rotation about a second axis of rotation and having a first cam surface in the path of the machine as the machine moves towards the occupying condition, said first cam surface being engageable by the machine as the machine moves toward the occupying condition to rotate said locking pawl from said blocking position to said releasing position.

9. The invention according to claim 5 and further including second biasing means for biasing said locking pawl to said blocking position, said locking pawl being mounted for rotation about a second axis of rotation and having a second cam surface in the path of the machine as the machine moves from the occupying condition to the non-occupying condition to rotate said locking pawl from said blocking position to said releasing position to enable rotation of said Geneva claw to the position wherein said first arm is in the path of the machine.

10. The invention according to claim 3 wherein said door means comprises a door configured to close the opening, hinge means attached to said door for pivotally supporting said door, rotatable axls means connected to said hinge means and crank means fixed to said axle means, said crank means being movable by said linkage means to move said door between positions opening and closing the opening, respectively.

11. The invention according to claim 10 wherein said door is pivotable through an obtuse angle between said open and closed positions, said linkage means includes link means slidable in generally forward and rearward horizontal directions, said link means having a forward end connected to said crank means, and said crank means is rotational about an axis through an obtuse angle measured rearwardly from the wall.

12. The invention according to claim 11 wherein said crank means includes a crank arm fixed to said axle means and a crank pin parallel to and spaced from said axle means and extending from said crank arm, said crank pin being connected to said link means for translating sliding motion of said link means into rotational movement of said axle means.

13. The invention according to claim 3 wherein the machine comprises the control unit of an automatic teller machine, the control unit including customer accessible components, and the wall comprises the fascia of the automatic teller machine, the fascia defining the opening occupied by the customer accessible components when the machine is in the occupying condition.

14. Apparatus for selectively opening and closing an opening in a wall according to the condition of a machine which selectively occupies said opening, the machine movable between an occupying condition wherein the machine occupies the opening, and a non-occupying condition wherein the machine does not occupy the opening, the apparatus comprising:

door means for closing said opening, said door means movable between an open condition uncovering the opening and a closed position closing the opening;

a movable first member mounted for rotation about a fixed axis and including first and second engagement means, said first engagement means being engageable in response to movement of the machine to the occupying condition to rotate said first member in a first direction, and said second engagement means being engageable in response to movement of the machine to the non-occupying condition to rotate said first member in a second direction; and link means connecting said first member and said door means and moving said door means to the open condition when said first member rotates in said first direction and to the closed condition when said first member rotates in said second direction.

15. Apparatus for selectively opening and closing an opening in a wall according to the condition of a machine which selectively occupies said opening, the machine movable between an occupying condition wherein the machine occupies the opening, and a non-occupying condition wherein the machine does not occupy the opening, the apparatus comprising:

door means for closing said opening, said door means being movable between an open condition uncovering the opening and a closed condition closing the opening;

a movable first member including first and second engagement means, said first engagement means being engageable in response to movement of the machine to the occupying condition to move said first member in a first direction, and said second engagement means being engageable in response to movement of the machine to the non-occupying condition to move said first member in a second direction;

biasing means biasing said first member in said first direction upon engagement of said first engagement means, and biasing said first member in said second direction upon engagement of said second engagement means; and link means connecting said first member and said door means and moving said door means to the open condition when said first member moves in the first direction, and to the closed condition when said first member moves in said second direction.

* * * * *